US005485522A

United States Patent [19]

Sölve et al.

[11] Patent Number: 5,485,522

[45] Date of Patent: Jan. 16, 1996

[54] SYSTEM FOR ADAPTIVELY REDUCING NOISE IN SPEECH SIGNALS

[75] Inventors: Torbjön W. Sölve, Cary; Robert A. Zak, Raleigh, both of N.C.

[73] Assignee: Ericsson GE Mobile Communications, Inc., Lynchburg, Va.

[21] Appl. No.: 128,639

[22] Filed: Sep. 29, 1993

[51] Int. Cl.[6] ..... G10L 3/00

[52] U.S. Cl. ..... 381/56; 381/44

[58] Field of Search ..... 381/56, 44, 46, 381/47; 455/218–219, 245.1

[56] References Cited

U.S. PATENT DOCUMENTS

| | | | |
|---|---|---|---|
| 4,506,381 | 3/1985 | Ono | 381/94 |
| 4,578,818 | 3/1986 | Claydon | 455/110 |
| 4,622,692 | 11/1986 | Cole | 381/94 |
| 4,790,018 | 12/1988 | Preves et al. | 381/68.2 |
| 4,837,832 | 6/1989 | Fanshel | 381/68.4 |
| 4,891,837 | 1/1990 | Walker et al. | 379/390 |
| 4,926,484 | 5/1990 | Nakano | 381/56 |
| 5,048,091 | 9/1991 | Sato et al. | 381/107 |
| 5,091,956 | 2/1992 | Miki | 381/91 |
| 5,148,484 | 9/1992 | Kane et al. | 381/56 |
| 5,285,502 | 2/1994 | Walton et al. | 381/94 |

FOREIGN PATENT DOCUMENTS

| | | |
|---|---|---|
| 0059650 | 9/1982 | European Pat. Off. . |
| 0451796 | 10/1991 | European Pat. Off. . |
| 0534837 | 3/1993 | European Pat. Off. . |

*Primary Examiner*—Stephen Brinich
*Attorney, Agent, or Firm*—Nixon & Vanderhye

[57] ABSTRACT

A method and system are provided for adaptively reducing noise in frames of digitized audio signals that may include both speech and background noise. Frames of digitized audio signals are processed to determine what attenuation (if any) should be applied to the current frame of digitized audio signals. Initially it is determined whether the current frame of digitized audio signals includes speech information, this determination being based upon an estimate of noise and on a speech threshold value. An attenuation value determined for the previous audio frame is modified based on this determination and applied to the current frame in order to minimize the background noise which thereby improves the quality of received speech. The attenuation applied to the audio frames is modified gradually on a frame-by-frame basis, each sample in a specific frame is attenuated using the value calculated for that frame. The adaptive noise reduction system may be advantageously applied to telecommunication systems in which portable radio transceivers communicate over RF channels because the adaptive noise reduction technique does not significantly increase data processing overhead.

33 Claims, 6 Drawing Sheets

SYSTEM FOR ADAPTIVELY REDUCING NOISE IN SPEECH SIGNALS

RELATED APPLICATIONS

The present invention is related to U.S. patent application Ser. No. 07/967,027 entitled "Multi-Mode Signal Processing" filed on Oct. 27, 1992 and assigned to the parent company of the present assignee.

FIELD OF THE INVENTION

The present invention relates to noise reduction systems, and in particular, to an adaptive noise reduction system for use in portable digital radio telephones.

BACKGROUND AND SUMMARY OF THE INVENTION

The cellular telephone industry has made phenomenal strides in commercial operations in the United States as well as the rest of the world. Demand for cellular services in major metropolitan areas is outstripping current system capacity. Assuming this trend continues, cellular telecommunications will reach even the smallest rural markets. Consequently, cellular capacity must be increased while maintaining high quality service at a reasonable cost. One important step towards increasing capacity is the conversion of cellular systems from analog to digital transmission. This conversion is also important because the first generation of personal communication networks (PCNs), employing low cost, pocket-size, cordless telephones that can be easily carried and used to make or receive calls in the home, office, street, car, etc., will likely be provided by cellular carriers using the next generation digital cellular infrastructure.

Digital communication systems take advantage of powerful digital signal processing (DSP) techniques. Digital signal processing refers generally to mathematical and other manipulation of digitized signals. For example, after converting (digitizing) an analog signal into digital form, that digital signal may be filtered, amplified, and attenuated using simple mathematical routines in the DSP. Typically, DSPs are manufactured as high speed integrated circuits so that data processing operations can be performed essentially in real time. DSPs may also be used to reduce the bit transmission rate of digitized speech which translates into reduced spectral occupancy of the transmitted radio signals and increased system capacity. For example, if speech signals are digitized using 14-bit linear Pulse Code Modulation (PCM) and sampled at an 8 KHz rate, a serial bit rate of 112 Kbits/sec is produced. Moreover, by taking mathematical advantage of redundancies and other predicable characteristics of human speech, voice coding techniques can be used to compress the serial bit rate from 112 Kbits/sec to 7.95 Kbits/sec to achieve a 14:1 reduction in bit transmission rate. Reduced transmission rates translate into more available bandwidth.

One popular speech compression technique adopted in the United States by the TIA for use as the digital standard for the second generation of cellular telephone systems (i.e., IS-54), is vector sourcebook excited linear predictive coding (VSELP). Unfortunately, when audio signals including speech mixed with high levels of ambient noise (particularly "colored noise") are coded/compressed using VSELP, undesirable audio signal characteristics result. For example, if a digital mobile telephone is used in a noisy environment, (e.g. inside a moving automobile), both ambient noise and desired speech are compressed using the VSELP encoding algorithm and transmitted to a base station where the compressed signal is decoded and reconstituted into audible speech. When the background noise is reconstituted into an analog format, undesirable, audible "swirling" is produced which sounds to the listener like a strong wind blowing in the background of the speaker. The "swirling sounds", which are more technically termed modulated interference, are particularly irritating to the average listener.

In theory, various signal processing algorithms could be implemented using digital signal processors to filter the VSELP encoded background noise. This solution, however, requires significant digital signal processing overhead, measured in terms of millions of instructions executed per second (MIPS), which consumes valuable processing time, memory space, and power consumption. Each of these signal processing resources, however, is limited in portable radiotelephones. Hence, simply increasing the processing burden of the DSP is not an optimal solution for minimizing VSELP encoded background noise. What is needed is an adaptive noise reduction system that reduces the undesirable contributions of encoded background ambient noise but minimizes any increased drain on digital signal processor resources.

The present invention provides a method and system for adaptively reducing noise in audio signals which does not significantly increase signal processing overhead and therefore has particularly advantageous application to digital portable radiotelephones. Frames of digitized audio signals including both speech and background noise are processed in a digital signal processor to determine what attenuation (if any) should be applied to a current frame of digitized audio signals. Initially, it is determined whether the current frame of digitized audio signals includes speech information, this determination being based upon an estimate of noise and on a speech threshold value. An attenuation value determined for the previous audio frame is modified based on this determination and applied to the current frame in order to minimize the background noise which improves the quality of received speech. The attenuation applied to the audio frames is modified gradually on a frame-by-frame basis, and each sample in a specific frame is attenuated using the attenuation value calculated for that frame.

The energy of the current frame is determined by summing the square of the amplitude of each sample in that frame. When the frame energy exceeds the sum of a noise estimate (the running average of the frame energy over the last several frames) and the speech threshold value, it is determined that speech is present in the current frame. Regardless if speech is detected, a variable attenuation is applied to each sample in the current frame based on the current noise estimate. Particularly desirable results are obtained when the variable attenuation factor is determined based upon a logarithmic ratio of the noise estimate and a minimum noise threshold below which no attenuation is applied.

In addition to the variable attenuation determined for and applied to each frame, a second no speech attenuation value is calculated and further gradually applied to each frame where speech is not detected. Like the variable attenuation value, the no speech attenuation value may also be determined based on a logarithmic function. This ensures that the background noise detected between speech samples is maximally attenuated.

The adaptive noise reduction system according to the present invention may be advantageously applied to telecommunication systems in which portable/mobile radio transceivers communicate over RF channels with each other and with fixed telephone line subscribers. Each transceiver includes an antenna, a receiver for converting radio signals received over an RF channel via the antenna into analog audio signals, and a transmitter. The transmitter includes a coder-decoder (codec) for digitizing analog audio signals to be transmitted into frames of digitized speech information, the speech information including both speech and background noise. A digital signal processor processes a current frame based on an estimate of the background noise and the detection of speech in the current frame to minimize background noise. A modulator modulates an RF carrier with the processed frame of digitized speech information for subsequent transmission via the antenna.

BRIEF DESCRIPTION OF THE DRAWINGS

These and other features and advantages of the present invention will be readily apparent to one of ordinary skill in the art from the following written description, read in conjunction with the drawings, in which.

DETAILED DESCRIPTION OF THE DRAWINGS

In the following description, for purposes of explanation and not limitation, specific details are set forth, such as particular circuits, circuit components, techniques, flow charts, etc. in order to provide a thorough understanding of the invention. However, it will be apparent to one skilled in the art that the present invention may be practiced in other embodiments that depart from these specific details. In other instances, detailed descriptions of well known methods, devices, and circuits are omitted so as not to obscure the description of the present invention with unnecessary details.

Figure 1:
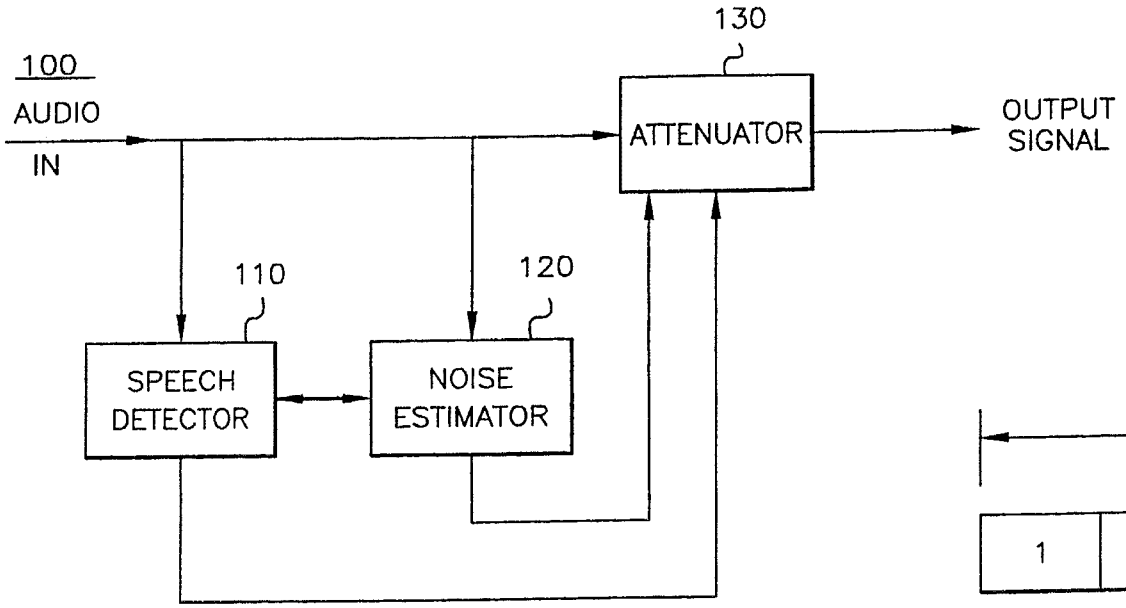
FIG. 1 is a general functional block diagram of the present invention.

FIG. 1 is a general block diagram of the adaptive noise reduction system 100 according to the present invention. Speech detector 110 detects whether a current block of digitized audio information includes speech based on the energy of the current block compared to the sum of a most recently determined noise estimate (by the noise estimator 120) and a speech threshold. The existence or nonexistence of speech in this block of audio signals is forwarded to the variable attenuator 130 and noise estimator 120. In order to continuously update and adapt the noise estimate, noise estimator 120 determines the difference between the energy in the current block and the previous noise estimate. When the speech detector decides no speech is present, this difference is used to update the noise estimate so as to reduce that difference to zero. Regardless of whether speech is detected, a variable attenuation is applied to the current block based on a nonlinear (i.e. logarithmic in a preferred embodiment) relationship between background noise as determined by the noise estimator 120. If speech is not detected in the current block, the attenuator 130 also gradually applies an incrementally increasing attenuation up to a fixed, "no speech" attenuation value for each block of audio for which speech is not detected. Each of these function blocks will be described in detail below.

Figure 2:
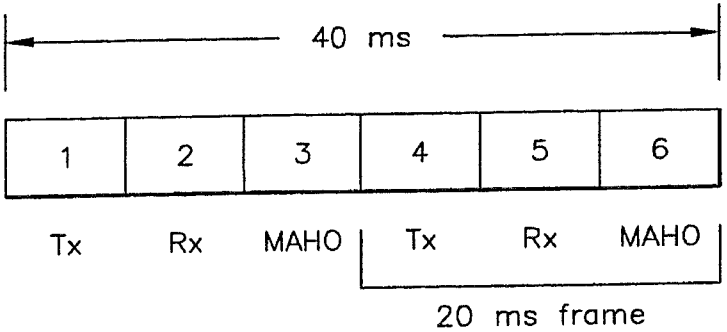
FIG. 2 illustrates the frame and slot structure of the U.S. digital standard IS-54 for cellular radio communications.

In an exemplary embodiment of the invention applied to portable/mobile radio telephone transceivers in a cellular telecommunications system, FIG. 2 illustrates the time division multiple access (TDMA) frame structure employed by the IS-54 standard for digital cellular telecommunications. A "frame" is a twenty millisecond time period which includes one transmit block TX, one receive block RX, and a signal strength measurement block used for mobile-assisted handoff (MAHO). The two consecutive frames shown in FIG. 2 are transmitted in a forty millisecond time period. Digitized speech and background noise information to be processed and attenuated on a frame-by-frame basis as further described below.

Figure 3:
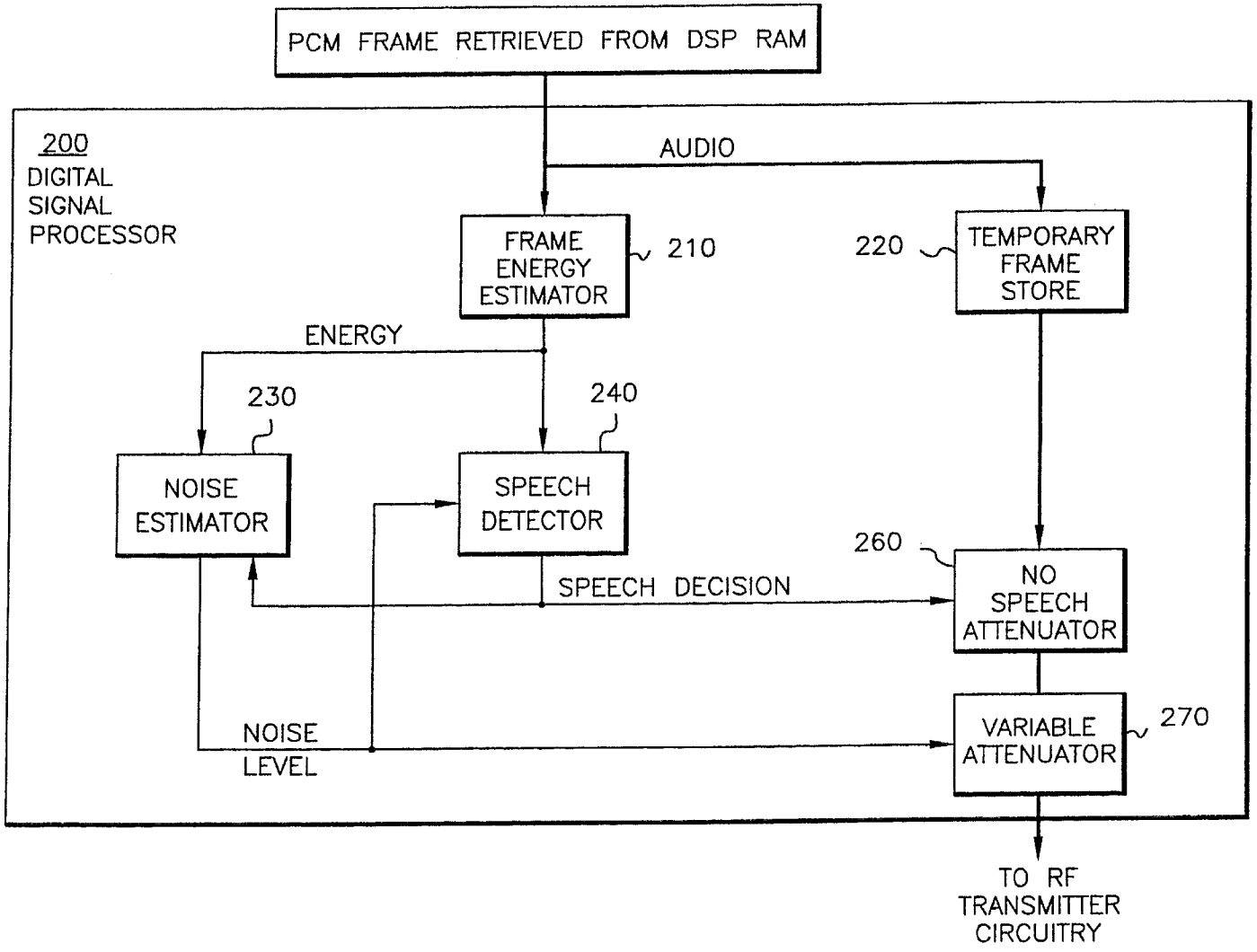
FIG. 3 is a block diagram of the present invention implemented using a digital signal processor.

Preferably, the functions of the speech detector 110, noise estimator 120, and attenuator 130 shown in FIG. 1 are implemented in the exemplary embodiment using a high speed digital signal processor 200 as illustrated in FIG. 3. One suitable digital signal processor is the TMS320C53 DSP available from Texas Instruments. The TMS320C53 DSP includes on a single integrated chip a sixteen-bit microprocessor, on-chip RAM for storing data such as speech frames to be processed, ROM for storing various data processing algorithms including the VSELP speech compression algorithm mentioned above, and other algorithms to be described below for implementing the functions performed by the speech detector 110, the noise estimator 120, and the attenuator 130.

As illustrated in FIG. 3, frames of pulse code modulated (PCM) audio information are sequentially stored in the DSP's on-chip RAM. Of course, the audio information could be digitized using other digitization techniques. Each PCM frame is retrieved from the DSP on-chip RAM, processed by frame energy estimator 210, and stored temporarily in temporary frame store 220. The energy of the current frame determined by frame energy estimator 210 is provided to noise estimator 230 and speech detector 240 function blocks. Speech detector 240 indicates that speech is present in the current frame when the frame energy estimate exceeds the sum of the previous noise estimate and a speech threshold. If speech is not detected (block 250), a no speech attenuator 260 is activated to gradually apply a no speech attenuation value that increases frame-by-frame from a relatively small, incremental value up to a maximum attenuation value. The no speech attenuation value calculated for each frame of digitized speech stored in the temporary frame store 220 is applied to each speech sample in that frame and passed on to variable attenuator 270. After the speech detector determines that no speech is present, the digital signal processor 200 calculates a difference or error between the previous noise estimate and the current frame energy (block 230). That difference or error is used to update the current noise estimate which is then provided to variable attenuator 270. If speech is detected in the current frame, the no speech attenuator 260 does not apply any attenuation value to the frame of digitized audio provided from the temporary frame store 220. Instead, that frame is attenuated only by variable attenuator 270. Note that if speech is not detected, the current frame of audio is attenuated by both the no speech attenuator 260 and variable attenuator 270. Variable attenuator 270 attenuates the current frame as a function of the currently determined noise estimate and a predetermined minimum threshold noise value. The adaptively attenuated speech signal is then passed on to conventional RF transmitter circuitry for transmission.

In general, nonlinear attenuation functions are preferred for the no speech attenuator 260 and variable attenuator 270 although other functions could also be used. In the preferred embodiment, a logarithmic attenuation function is used to determine the attenuation to be applied to the current frame with respect to a currently estimated background noise level because logarithmic functions are continuous and are good approximations of the hearing response the human ear.

Figure 4:
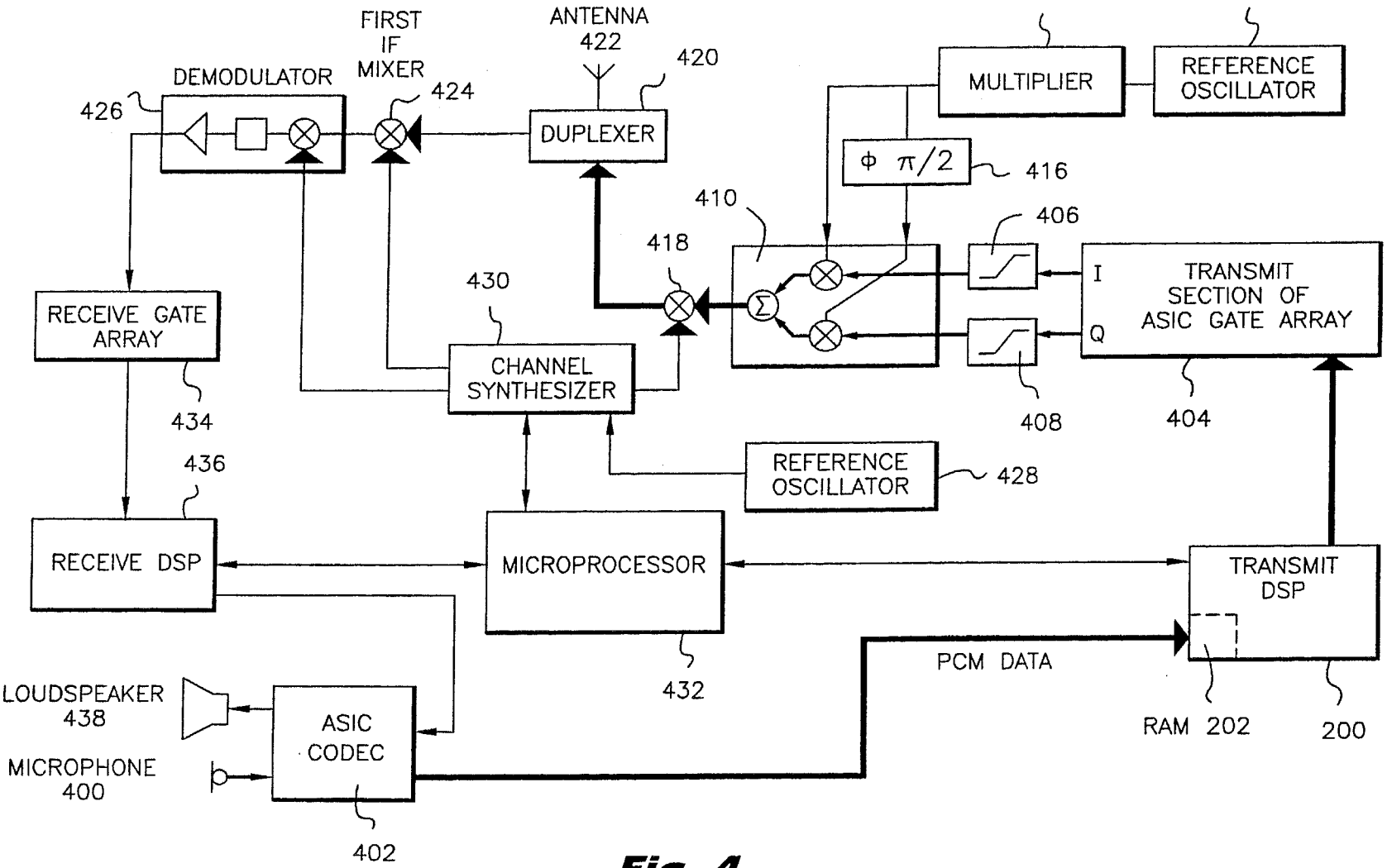
FIG. 4 is a function block diagram of an exemplary embodiment of the present invention in one of plural portable radio transceivers in a telecommunication system.

The digital signal processor 200 described in conjunction with FIG. 3 may be used, for example, in the transceiver of a digital portable/mobile radiotelephone used in a radio telecommunications system. FIG. 4 illustrates one such digital radio transceiver which may be used in a cellular telecommunications network. Although FIG. 4 generally describes the basic function blocks included in the radio transceiver, a more detailed description of this transceiver may be obtained from the previously referenced U.S. patent application Ser. No. 07/967,027 entitled "Multi-Mode Signal Processing" which is incorporated herein by reference.

Audio signals including speech and background noise are input in a microphone 400 to a coder-decoder (codec) 402 which preferably is an application specific integrated circuit (ASIC). The band limited audio signals detected at microphone 400 are sampled by the codec 402 at a rate of 8,000 samples per second and blocked into frames. Accordingly, each twenty millisecond frame includes 160 speech samples. These samples are quantized and converted into a coded digital format such as 14-bit linear PCM. Once 160 samples of digitized speech for a current frame are stored in a transmit DSP 200 in on-chip RAM 202, the transmit DSP 200 performs digital speech coding/compression in accordance with the VSELP algorithm, gain control, filtering, and error correction functions as well as the frame energy estimation, noise estimation, speech detection, and fixed/variable attenuation functions as described above in conjunction with FIG. 3.

A supervisory microprocessor 432 controls the overall operation of all of the components in the transceiver shown in FIG. 4. The attenuated PCM data stream generated by transmit DSP 200 is provided for quadrature modulation and transmission. To this end, an ASIC gate array 404 generates in-phase (I) and quadrature (Q) channels of information based upon the attenuated PCM data stream from DSP 200. The I and Q bit streams are processed by matched, low pass filters 406 and 408 and passed onto IQ mixers in balanced modulator 410. A reference oscillator 412 and a multiplier 414 provide a transmit intermediate frequency (IF). The I signal is mixed with in-phase IF, and the Q signals are mixed with quadrature IF (i.e., the in-phase IF delayed by 90 degrees by phase shifter 416). The mixed I and Q signals are summed, converted "up" to an RF channel frequency selected by channel synthesizer 430, and transmitted via duplexer 420 and antenna 422 over the selected radio frequency channel.

On the receive side, signals received via antenna 422 and duplexer 420 are down converted from the selected receive channel frequency in a mixer 424 to a first IF frequency using a local oscillator signal synthesized by channel synthesizer 430 based on the output of reference oscillator 428. The output of the first IF mixer 424 is filtered and down converted in frequency to a second IF frequency based on another output from channel synthesizer 430 and demodulator 426. A receive gate array 434 then converts the second IF signal into a series of phase samples and a series of frequency samples. The receive DSP 436 performs demodulation, filtering, gain/attenuation, channel decoding, and speech expansion on the received signals. The processed speech data are then sent to codec 402 and converted to baseband audio signals for driving loudspeaker 438.

The operations performed by the digital signal processor 200 for implementing the functions of frame energy estimator 210, noise estimator 230, speech detector 240, no speech attenuator 260, and variable attenuator 270 will now be described in conjunction with the flow charts illustrated in FIGS. 5(*a*) and 5(*b*). Frame energy estimator 210 determines the energy in each frame of audio signals. In the first step 505, DSP 200 determines the energy of the current frame by calculating the sum of the squared values of each PCM sample in the frame. Since there are 160 samples per twenty millisecond frame for an 8000 samples per second sampling rate, 160 squared PCM samples are summed. Expressed mathematically, the frame energy estimate is determined according to the following:

$$\text{frame energy} = \sum_{i=1}^{160} |PCM_i|^2 \tag{1}$$

The frame energy value calculated for the current frame is stored in the on-chip RAM 202 of DSP 200 in step 510.

The functions of speech detector 240 include (in step 515) fetching a noise estimate previously determined by noise estimator 230 from the on-chip RAM of DSP 200. Of course, when the transceiver is initially powered up, no noise estimate will exist. Decision block 520 anticipates this situation and assigns a noise estimate in step 525. Preferably, an arbitrarily high value, e.g. 20 dB above normal speech levels, is assigned as the noise estimate in order to force an update of the noise estimate value as will be described below. The frame energy determined by frame energy estimator 210 is retrieved from the on-chip RAM 202 of DSP 200 in block 530. A decision is made in block 535 whether the frame energy estimate exceeds the sum of the retrieved noise estimate plus a predetermined speech threshold value.

$$\text{frame energy estimate} > (\text{noise estimate} + \text{speech threshold}) \tag{2}$$

The speech threshold value may be a fixed value determined empirically to be larger than short term energy variations of typical background noise and may, for example, be set to 9 dB. In addition, the speech threshold value may be adaptively modified to reflect changing speech conditions such as when the speaker enters a noisier or quieter environment. If the frame energy estimate exceeds the sum in equation (2), a flag is set in block 570 that speech exists. Conversely, if the frame energy estimate is less than the sum in equation (2), the speech flag is reset in block 540.

If speech does not exist, the noise estimation update routine of noise estimator 230 is executed. In essence, the noise estimate is a running average of the frame energy during periods of no speech. As described above, if the initial start-up noise estimate is chosen sufficiently high, speech is not detected, and the speech flag will be reset thereby forcing an update of the noise estimate.

In the noise estimation routine followed by noise estimator 230, a difference/error (Δ) is determined in block 545 between the frame noise energy generated by frame energy estimator 210 and a noise estimate previously calculated by noise estimator 230 in accordance with the following equation:

$$\Delta = \text{current frame energy} - \text{previous noise estimate} \quad (3)$$

A determination is made in decision block 550 whether Δ exceeds zero. If Δ is negative, as occurs for high values of the noise estimate, then the noise estimate is recalculated in block 560 in accordance with the following equation:

$$\text{noise estimate} = \text{previous noise estimate} + \Delta/2 \quad (4)$$

Since Δ is negative, this results in a downward correction of the noise estimate. The relatively large step size of Δ/2 is chosen to rapidly correct for decreasing noise levels. However, if the frame energy exceeds the noise estimate, providing a Δ greater than zero, the noise is updated in block 555 in accordance with the following equation:

$$\text{noise estimate} = \text{previous noise estimate} + \Delta/256 \quad (5)$$

Since Δ is positive, the noise estimate must be increased. However, a smaller step size of Δ/256 (as compared to Δ/2) is chosen to gradually increase the noise estimate and provide substantial immunity to transient noise.

Figure 5A:
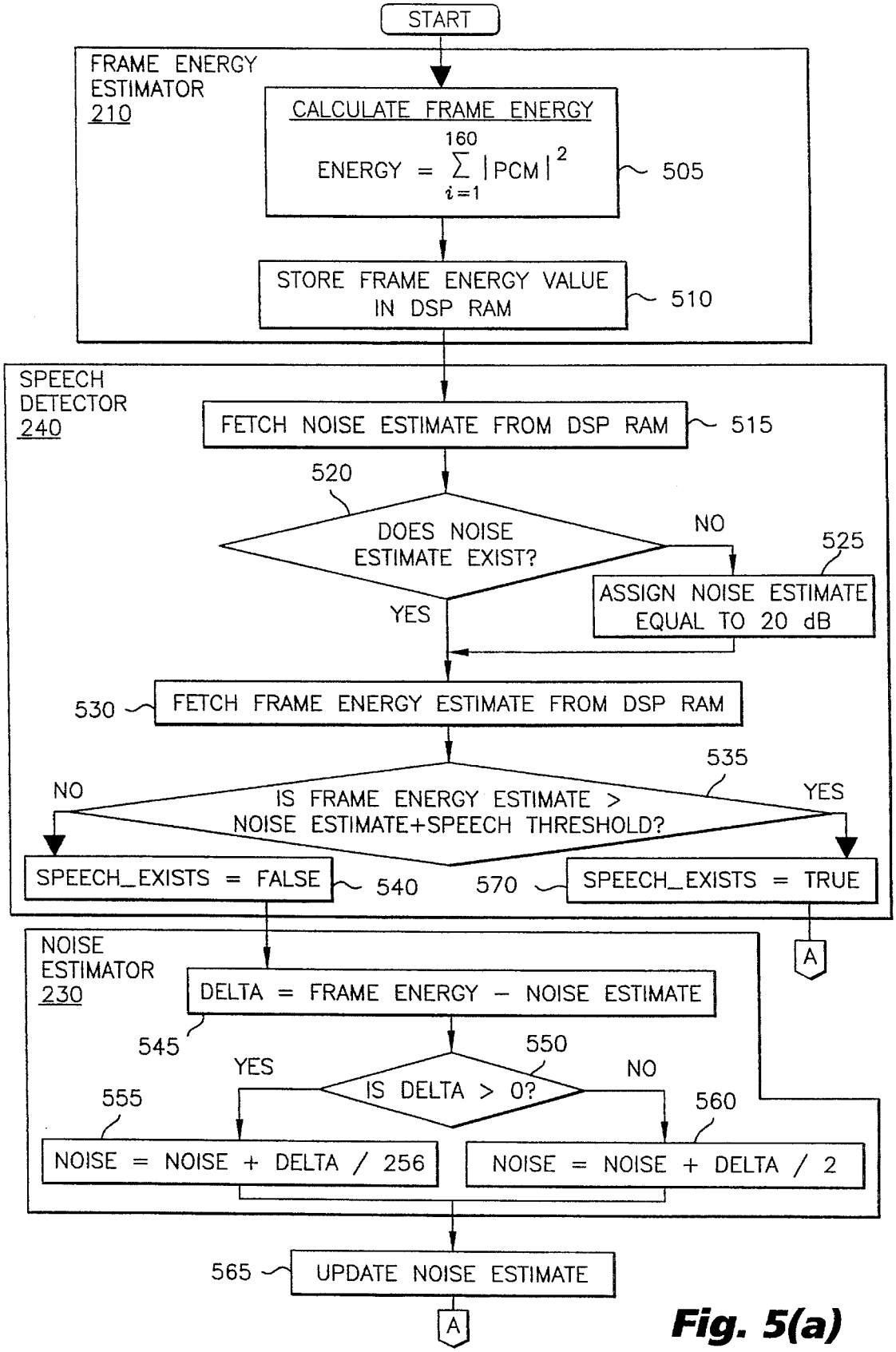
FIG. 5(*a*) and 5(*b*) are flow charts which illustrate functions/operations performed by the digital signal processor in implementing the present invention.
Figure 5B:
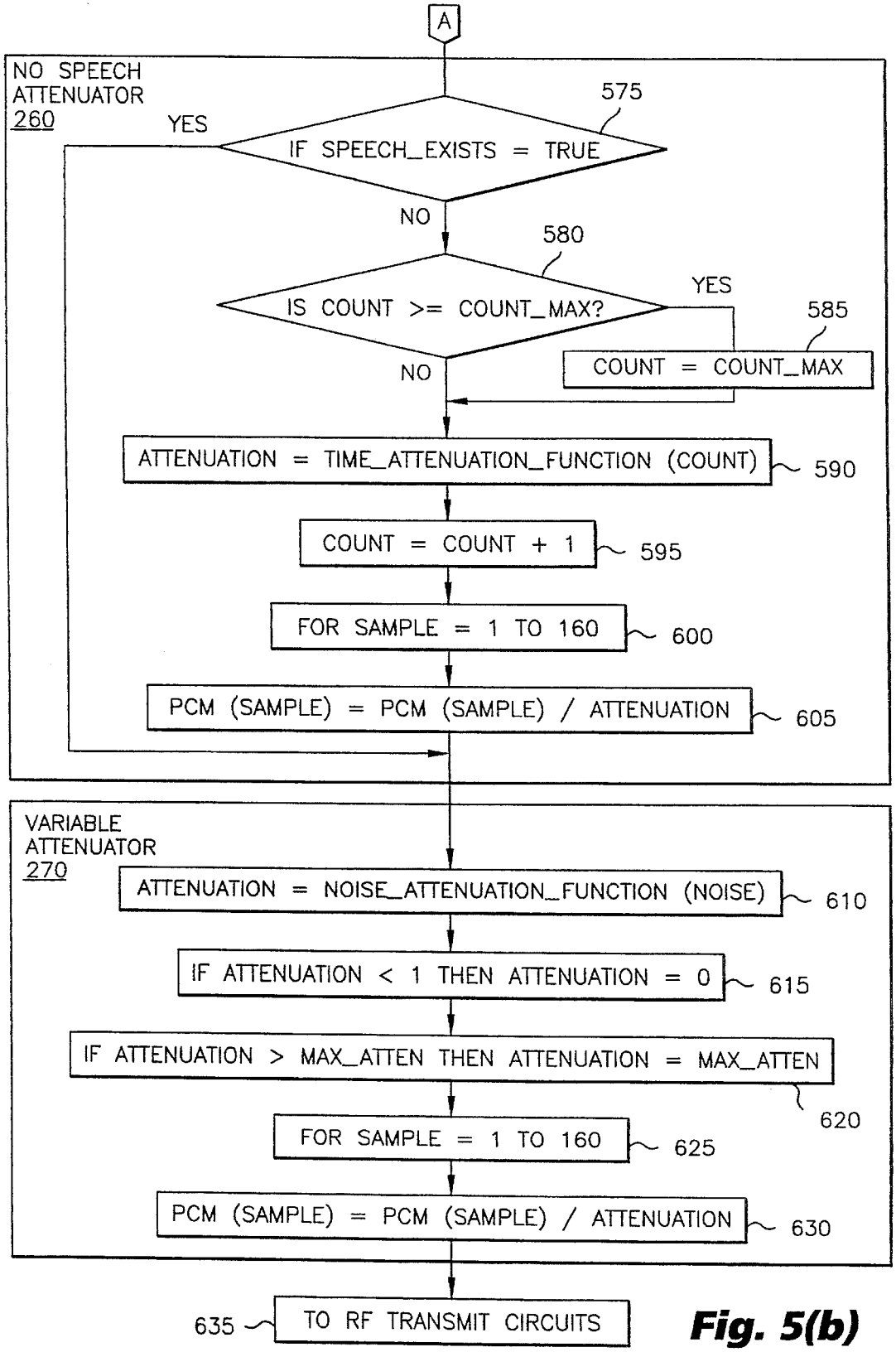

Flow continues from the updated noise estimate block 565 and the speech exists block 570 in FIG. 5(*a*) to decision block 575 in the fixed attenuator 260 in FIG. 5(*b*) to determine whether the speech flag has been set. If it has, the no speech attenuator 260 is bypassed and control moves to variable attenuator 270. However, if the speech flag is reset during no speech intervals, a count variable value, i.e. COUNT, is set to zero. The count variable is the mechanism by which the no speech attenuator 260 applies the no speech attenuation to frames of digitized audio signals in which no speech has been detected. Rather than immediately applying a full attenuation value to the first frame of digitized audio signals for which no speech is detected, the no speech attenuator 260 applies a gradually increasing no speech attenuation value to successive frames of audio signals having no speech. In the present embodiment, for example, eight frames are required to apply the full no speech attenuation which may be, for example, 6 dB. For the first frame for which no speech is detected, COUNT equals one. In decision block 580, a determination is made whether the COUNT is greater than or exceeds the count maximum (COUNTMAX), e.g. eight frames. If so, the COUNT is limited to the count maximum in block 585. In this way, only a maximum attenuation is ever applied to a frame of digitized signals. The no speech attenuation is calculated in block 590 in accordance with a logarithmic time attenuation function as follows:

$$\text{Attenuation (COUNT)} = \log^{-1}[(\text{COUNT/COUNTMAX})(-6\text{ dB}/20)] \quad (6)$$

Thereafter, the COUNT value is incremented by one in step 595, and the no speech attenuation value calculated in accordance with equation (6) is applied to each sample in the current frame, e.g. 160 samples (blocks 600 and 605). Although logarithmic attenuation functions are preferred, other gradually changing functions could also be used to calculate the no speech attenuation value.

Irrespective of whether speech is detected by speech detector 240, a variable attenuation value is applied to every frame of PCM values at one of a plurality of predetermined levels of attenuation in accordance with the noise estimate value. In current frames for which no speech is detected, both no speech attenuation and a variable attenuation are applied to the frame samples. Like no speech attenuator 260, variable attenuator 270 gradually applies an attenuation value in one of multiple levels between minimum and maximum attenuation levels lying along a logarithmic curve. For example, sixteen incrementally increasing attenuation levels could be used. In step 610, the variable attenuation is calculated as a function of the noise estimate as follows:

$$\text{Variable Attenuation (noise)} = T_1 * \log\{[\log(\text{noise}/T_1)]/K\} \quad (7)$$

The noise variable is the updated noise estimate provided by noise estimator 230. $T_1$ is a threshold which defines a minimum noise value below which no attenuation is applied. K is a scaling factor used to change the slope of the attenuation versus noise characteristic. For example, when K equals 2, there is a 1 dB increase in attenuation for every 2 dB increase in noise level above threshold $T_1$. If the attenuation determined in block 610 is less than 1, then the attenuation is set to the minimum attenuation level of zero (block 615). In step 620, if the attenuation determined in step 610 is greater than the maximum level of attenuation, the attenuation is set to the maximum attenuation value, e.g. 6 dB. The calculated variable attenuation value is then applied to the current frame of PCM samples (steps 625 and 630) and transmitted to the RF transmit circuits (step 635).

In a worse case situation where both the no speech and variable attenuators are applied to frames where no speech is detected, a maximum of 12 dB total attenuation may for example be applied to the PCM frame samples before the frame is coded and compressed using the above mentioned VSELP voice coding algorithm. By attenuating the frames of audio signals in accordance with the present invention before voice coding, background noise is minimized which substantially reduces any undesired noise effects, e.g. swirling, in the speech when it is reconstituted. While the DSP 200 may perform the speech detection, attenuation, and noise estimation functions before VSELP voice coding, those functions may also be performed after VSELP coding to reduce the data processing overhead of the transmit DSP 200.

A significant advantage of the present invention is that neither the no speech nor the variable attenuations are applied abruptly. Instead, both attenuations are applied gradually on a frame-by-frame basis until the maximum level of fixed and/or variable attenuation is reached. This gradual application of attenuation is illustrated in FIGS. 6 and 7, where the curves are graphed on a logarithmic scale.

Figure 6:
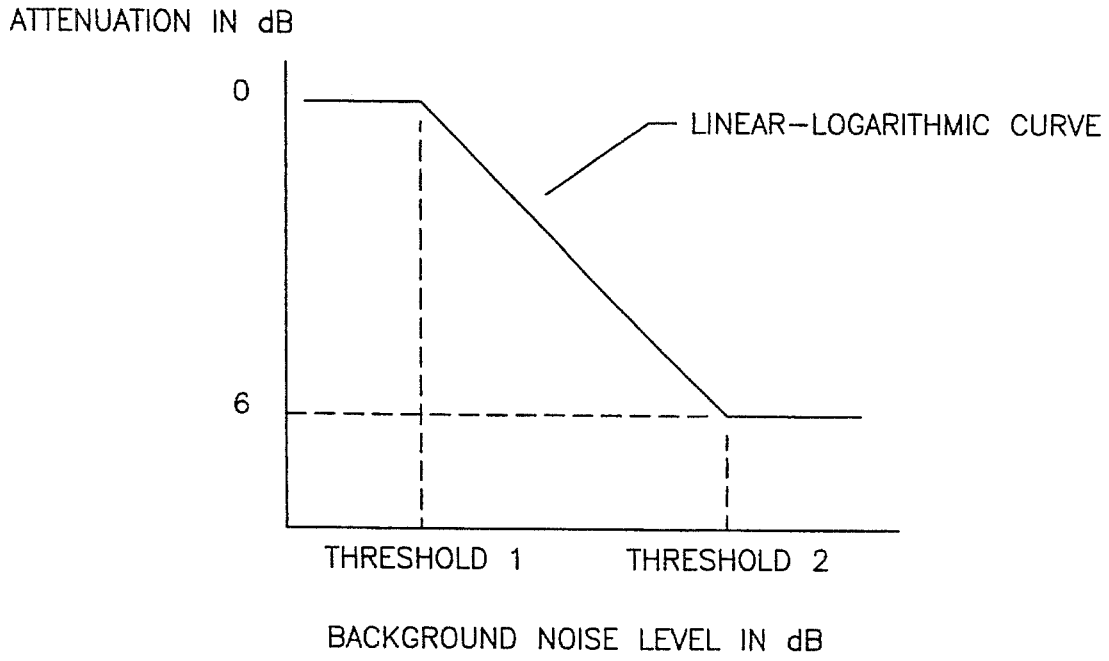
FIG. 6 is a graph illustrating the attenuation vs. noise level characteristic of the noise adaptive attenuator according to the present invention.

FIG. 6 shows the attenuation vs. noise level characteristic (in dB) of the variable attenuator 270 on a logarithmic scale. Background noise levels up to threshold 1 are not attenuated. This is to ensure that during periods of silence, some level of "comfort noise" is heard by the person on the receiving end of the communication which assures that person that the call connection is still valid. Conversely, the second threshold corresponds to the maximum level of attenuation. By setting a maximum level of attenuation, distinct and undesirable breaks in the conversation heard by the person on the receiving end of the call are avoided. Between the two thresholds, attenuation is determined using a nonlinear type curve such as log-log, cosine, polynomial, etc. that improve the sound quality of the digitized speech. In the preferred embodiment, the logarithmic curve defined by equation (7) is illustrated on the logarithmic scale as a straight line. As the background noise level increases beyond the minimum threshold 1, the variable attenuation value increases logarithmically. For example, sixteen gradually increasing levels of variable attenuation along the variable attention logarithmic function curve may be incrementally applied. Of course, those skilled in the art will appreciate that a variety of different nonlinear functions may be used to apply attenuation to current frames of speech samples and that these attenuation values may be also determined using a table lookup method as opposed to calculating them in real time.

Figure 7:
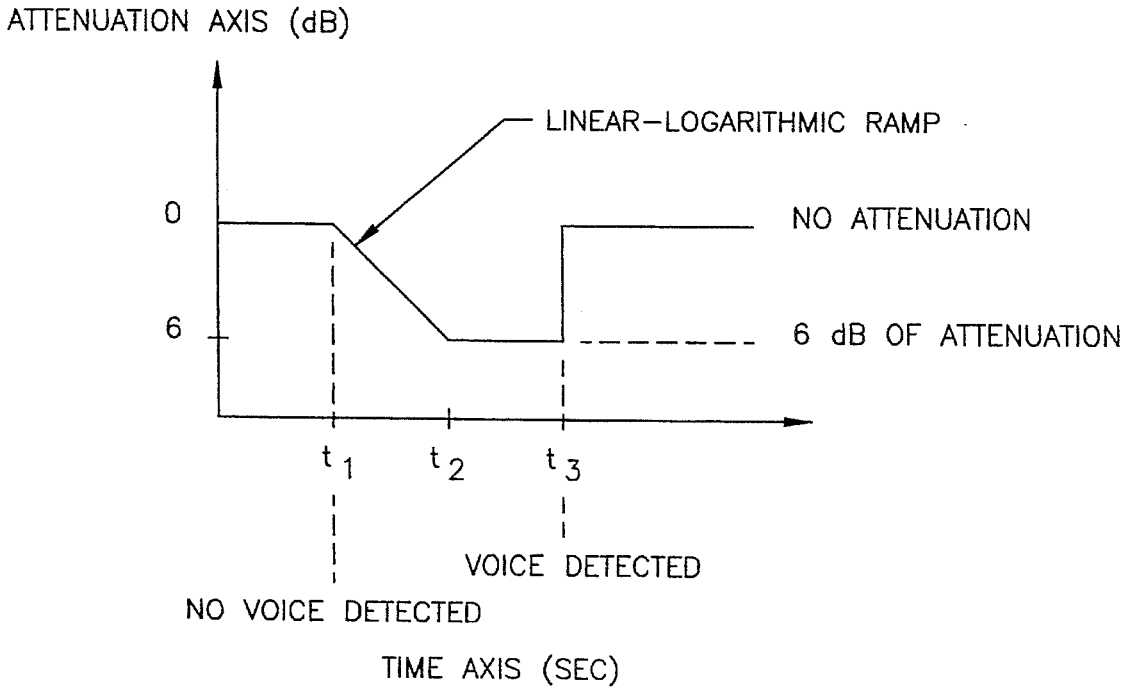
FIG. 7 is a graph illustrating the attenuation vs. time characteristic of the no speech attenuator according to the present invention.

FIG. 7 illustrates a no speech attenuation vs. time curve characteristic. At time $t_1$, no speech is detected in the currently processed frame of digitized audio signals. Incrementally increasing values of attenuation are applied up to the maximum attenuation value of 6 dB at time $t_2$. Thus, assuming a maximum count of eight, no additional attenuation is applied after eight consecutive no speech frames. For example, sixteen incrementally increasing levels of variable attenuation along the variable attention logarithmic function curve may be applied. At time $t_3$, speech is detected, and the fixed attenuation is removed.

As is evident from the description above, the adaptive noise attenuation system of the present invention is implemented simply and without significant increase in DSP calculations. More complex methods of reducing noise, such as "spectral subtraction," require several calculation-related MIPS and a large amount of memory for data and program code storage. By comparison, the present invention may be implemented using only a fraction of a MIPS and a relatively small memory. Reduced memory reduces the size of the DSP integrated circuits; decreased MIPS decreases power consumption. Both of these attributes are desirable for battery-powered portable/mobile radiotelephones. As described earlier, further reduction in DSP overhead may be achieved by performing adaptive noise reduction after speech coding.

While the invention has been particularly shown and described with reference to the preferred embodiments thereof, it is not limited to those embodiments. For example, although a DSP is disclosed as performing the functions of the frame energy estimator 210, noise estimator 230, speech detector 240, no speech attenuator 260, and variable attenuator 270, these functions could be implemented using other digital and/or analog components. It will be understood by those skilled in the art that various alterations in form and detail may be made therein without departing from the spirit and scope of the invention.

What is claimed is:

1. A method of reducing noise in audio signals, comprising:

receiving frames of digitized audio signals which include speech and background noise;

detecting whether the current frame includes speech information;

dynamically determining an attenuation to be applied to the digitized audio signals in accordance with the detection of speech that minimizes the background noise; and applying the determined attenuation to the digitized audio signals, wherein the determined attenuation is gradually modified from a previously applied attenuation.

2. A method of reducing noise in audio signals, comprising:

receiving frames of digitized audio signals which include speech and background noise;

detecting whether the current frame includes speech information;

dynamically determining an attenuation to be applied to the digitized audio signals in accordance with the detection of speech that minimizes the background noise;

applying the determined attenuation to the digitized audio signals; and determining the energy of a current frame of digitized audio signals, wherein the detecting step detects whether the current frame includes speech information based on an estimate of background noise and a speech threshold value.

3. The method according to claim 2, wherein the digitized audio signals include plural samples for each frame and the determining step includes summing the square of the amplitude of each sample in the current frame, the sum representing the energy of the current frame.

4. The method according to claim 2, further comprising:

comparing the determined frame energy with the sum of the noise estimate and the speech threshold value, wherein speech is detected when the determined frame energy exceeds the sum of the noise estimate and the speech threshold value.

5. The method according to claim 1, wherein the dynamically determining step includes:

calculating a first attenuation when no speech is detected in the detecting step and applying the first attenuation to the digitized audio signals, and calculating and applying a second attenuation to the digitized audio signals.

6. The method according to claim 2, further comprising:

if no speech is detected, updating the noise estimate by determining a difference between the current frame energy and a current noise estimate and adjusting the noise estimate to minimize the difference.

7. The method according to claim 6, further comprising:

comparing the difference to zero, if the difference is negative, subtracting a significant proportion of the difference from the current noise estimate, and if the difference is negative, adding a small proportion of the difference, relative to the significant proportion, to the current noise estimate.

8. The method according to claim 1, wherein the determined attenuation is modified based on a logarithmic function of the background noise.

9. The method according to claim 1, wherein the determined attenuation is limited between maximum and minimum attenuation values, and between those maximum and minimum values, the attenuation is modified based on a logarithmic function of the background noise.

10. The method according to claim 1, wherein the determined attenuation is gradually and nonlinearly modified from the previously applied attenuation value.

11. The method according to claim 1, wherein the determined attenuation is determined based on a logarithmic ratio of the noise estimate and a minimum attenuation threshold multiplied by a scaling factor.

12. The method according to claim 11, wherein the scaling factor is varied to change the rate at which the determined attenuation is changed.

13. The method according to claim 1, wherein the determined attenuation is modified incrementally frame-by-frame by a first attenuation factor if speech information is not detected in the detecting step.

14. The method according to claim 13, wherein the determined attenuation is incrementally adjusted by a second attenuation factor which is based on the noise estimate.

15. The method according to claim 2, wherein when no speech is detected, the noise estimate is a running average of the frame energy.

16. An apparatus for reducing noise in received frames of digitized audio signals which include speech and background noise, comprising:

a speech detector for detecting whether a current frame of digitized audio signals includes speech information, and an attenuator for determining an attenuation, limited by maximum and minimum attenuation values, to be applied to the digitized audio signals, based on the detection of speech and a function of background noise, that minimizes the background noise and for applying the determined attenuation to the digitized audio signals.

17. The apparatus according to claim 16, further comprising:

a frame energy estimator for determining the energy of a current frame of digitized audio signals, and a noise estimator for determining an estimate of the background noise, wherein the speech detector detects whether the current frame includes speech information based on an noise estimate and a speech threshold value.

18. The apparatus according to claim 17, wherein the digitized audio signals include plural samples for each frame and the frame energy estimator sums the square of the amplitude of each sample in the current frame, the sum representing the energy of the current frame.

19. The apparatus according to claim 17, further comprising:

a comparator for comparing the determined frame energy with the sum of the noise estimate and the speech threshold value, wherein the speech detector detects speech when the determined frame energy exceeds the sum of the noise estimate and the speech threshold value.

20. The apparatus according to claim 16, wherein the attenuator includes:

a no speech attenuator for determining and applying a first attenuation to the digitized audio signals when no speech is detected by the speech detector, and a variable attenuator for determining and applying a second attenuation to the digitized audio signals.

21. The apparatus according to claim 20, wherein the first attenuation is only applied to the audio signals when speech is not detected by the no speech detector.

22. The apparatus according to claim 17, wherein the noise estimator updates the background noise estimate in the absence of speech by determining a difference between the frame energy and a current background noise estimate and adjusting the background noise estimate to minimize the difference.

23. The apparatus according to claim 16, wherein the determined attenuation is gradually and nonlinearly modified from the previously applied attenuation value.

24. The apparatus according to claim 16, wherein the function is a logarithmic function of the background noise.

25. The apparatus according to claim 24, wherein the logarithmic function is determined based on a logarithmic ratio of a noise estimate and a minimum attenuation threshold multiplied by a scaling factor.

26. A telecommunications system in which portable radio transceivers communicate over rf channels, each transceiver comprising:

an antenna;

a receiver for converting radio signals received over an rf channel via the antenna into analog audio signals; and a transmitter including:

a codec for digitizing analog audio signals into frames of digitized speech information, the digitized speech information including speech and background noise;

a digital signal processor for processing the digitized speech information based on an estimate of the background noise and a detection of speech in the current frame to minimize the background noise; and a modulator for modulating an rf carrier with the processed frame of digitized speech information for transmission via the antenna.

27. The system according to claim 26, wherein the digital signal processor includes:

a speech detector, and a no speech attenuator which applies a no speech attenuation to the digitized speech information signals.

28. The system according to claim 26, wherein the digital signal processor includes:

a speech detector, and a variable attenuator which applies a variable attenuation to the digitized speech information.

29. The system according to claim 26, wherein the digital signal processor includes:

a frame energy estimator for determining the energy of a current frame of digitized audio signals, and a noise estimator for determining an estimate of the background noise by taking a difference between the frame energy and a current background noise estimate and adjusting the background noise estimate in the absence of speech to minimize the difference.

30. The system according to claim 28, wherein the variable attenuation is determined based on a logarithmic function of the background noise estimate.

31. The apparatus according to claim 27, wherein the no speech attenuation is limited between maximum and minimum attenuation values.

32. The apparatus according to claim 26, wherein the digital signal processor minimizes background noise by attenuating the digitized speech information gradually and nonlinearly using a nonlinear attenuation function.

33. The method according to claim 32, wherein the nonlinear attenuation function is based on a logarithmic ratio of the noise estimate and a minimum attenuation threshold.

* * * * *